US010202985B2

(12) United States Patent
Kucukcelebi

(10) Patent No.: US 10,202,985 B2
(45) Date of Patent: Feb. 12, 2019

(54) SYSTEM PREVENTING PRESSURED OIL LEAKAGE TO CYLINDER LINE IN CONTROL VALVE SYSTEMS WITH FLOW DIVIDER

(71) Applicant: HEMA ENDUSTRI ANONIM SIRKETI, Tekirdag (TR)

(72) Inventor: Vahit Olcay Kucukcelebi, Tekirdag (TR)

(73) Assignee: Hema Endustri Anonim Sirketi, Tekirdag (TR)

( * ) Notice: Subject to any disclaimer, the term of this patent is extended or adjusted under 35 U.S.C. 154(b) by 748 days.

(21) Appl. No.: 14/434,878

(22) PCT Filed: Jul. 12, 2013

(86) PCT No.: PCT/TR2013/000254
§ 371 (c)(1),
(2) Date: Apr. 10, 2015

(87) PCT Pub. No.: WO2014/062142
PCT Pub. Date: Apr. 24, 2014

(65) Prior Publication Data

US 2015/0267718 A1 Sep. 24, 2015

(30) Foreign Application Priority Data

Oct. 19, 2012 (TR) ..... 2012/12073

(51) Int. Cl.

| | |
|---|---|
| ***F15B 9/12*** | (2006.01) |
| ***F15B 11/00*** | (2006.01) |
| ***F15B 11/16*** | (2006.01) |
| ***F15B 13/02*** | (2006.01) |
| *F15B 13/01* | (2006.01) |
| *F15B 13/042* | (2006.01) |

(52) U.S. Cl.
CPC ..... *F15B 9/12* (2013.01); *F15B 11/003* (2013.01); *F15B 11/162* (2013.01); *F15B 13/022* (2013.01); *F15B 13/015* (2013.01); *F15B 13/0426* (2013.01); *F15B 2211/30515* (2013.01); *F15B 2211/321* (2013.01); *F15B 2211/324* (2013.01); *F15B 2211/326* (2013.01); *F15B 2211/4053* (2013.01); *F15B 2211/428* (2013.01); *F15B 2211/6355* (2013.01); *F15B 2211/781* (2013.01)

(58) Field of Classification Search
CPC ..... F15B 11/162; F15B 13/022; F15B 2211/781; F15B 2211/326; F15B 9/12
See application file for complete search history.

(56) References Cited

U.S. PATENT DOCUMENTS

| | | | | | |
|---|---|---|---|---|---|
| 3,307,455 | A * | 3/1967 | Peras | A01B 63/112 | 91/367 |
| 3,906,838 | A * | 9/1975 | Hofer | F15B 11/16 | 91/459 |
| 4,184,334 | A * | 1/1980 | Orth | A01B 67/00 | 251/122 |
| 4,835,966 | A * | 6/1989 | Kauss | F15B 13/015 | 60/376 |

* cited by examiner

*Primary Examiner* — F. Daniel Lopez
*Assistant Examiner* — Michael Quandt
(74) *Attorney, Agent, or Firm* — Inventa Capitol PLC

(57) ABSTRACT

The present invention relates to a system preventing the pressured oil leakage in a cylinder line enabling very low leakage rates without using the valve or the system, or without reducing the diametrical space between the housing and spool.

1 Claim, 1 Drawing Sheet

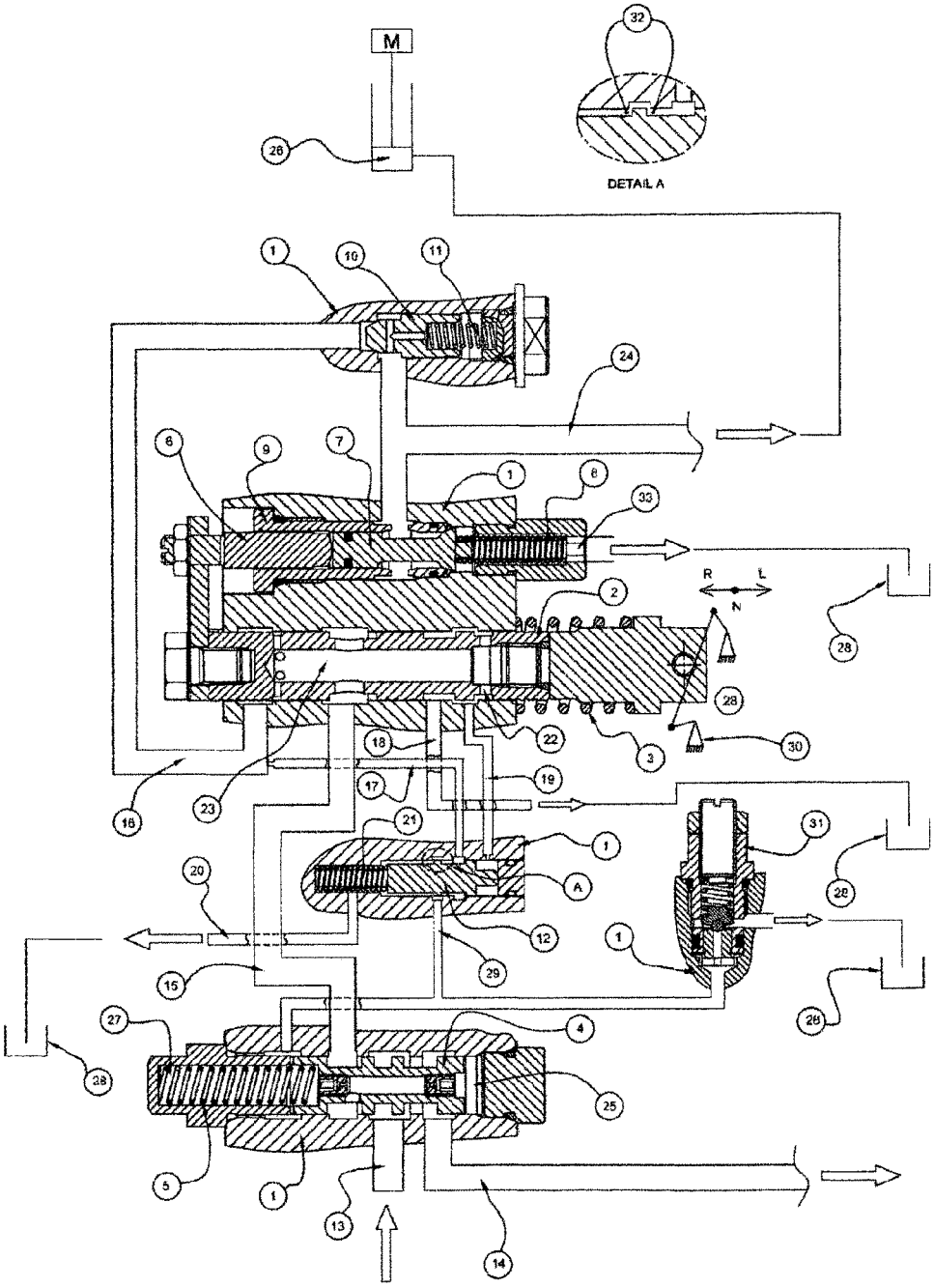
M
DETAIL A
R
L
N
A

SYSTEM PREVENTING PRESSURED OIL LEAKAGE TO CYLINDER LINE IN CONTROL VALVE SYSTEMS WITH FLOW DIVIDER

TECHNICAL FIELD

This invention relates to control of hydraulic lifts with mechanical control enabling use of the three-point hitch system and equipments attached to the said system in tractors and agricultural machineries.

PRIOR ART

In the current hydraulic lift control valves with flow divider valve, fluid flow propulsed by pump enters into the control valve, and the fluid flow is divided into two parts between hydraulic lift cylinder line and excess flow line by means of the flow divider valve in the control valve. Hydraulic lift cylinder line is attached to hydraulic lift cylinder, the cylinders are attached to three-point hitch system and the three-point hitch system is attached to the tractor equipment, thereby the hydraulic lift cylinder line controls the equipment.

The excess flow line is a line to which external control valves are attached. These valves are used to control other hydraulic systems (E.g. digger) other than the system to control location of the equipment on the three-point hitch system on the tractor, or to control the hydraulic systems inside of the equipment (E.g. rotary plough).

Systems including flow divider enable simultaneous use of both valves by dividing flow propulsed by the pump; however, the hydraulic lift cylinder and the excess flow lines are not necessarily to be pressurized simultaneously or to work at the same pressure levels.

In the current systems, when the excess flow line is pressurized, the hydraulic lift cylinder line is also pressurized. That is, to exemplify, when the driver of vehicle intends to raise the bucket in front of the vehicle attached to the excess flow line, the load (equipment) attached to back of the vehicle is also raised. The reason of this situation arising against the driver's will and beyond his control is the oil leakage from the control valve between the oil lines. In other words, when the excess flow line is pressurized, the pressurized oil leaks into the hydraulic lift cylinder line through the voids in the control valve and the hydraulic lift cylinder is also pressurized and gets move.

In present systems, the diametrical space between the housing and spool is required to be reduced which causes the spool to be stuck in the housing.

Another method used to prevent such mistake is to increase lapping distances between the housing and the spool. When this method, however, is used response time of the hydraulic system increases and the equipment gives late response, which causes significant problems specially during plowing.

Both of the solution methods described above cannot provide exact solution for the problem, but only retard pressurization of the cylinder line.

SUMMARY OF THE INVENTION

The objective of this invention is to provide a system preventing the pressured oil leakage in a cylinder line preventing the oil leaking from the excess flow line to the hydraulic lift cylinder line from pressurizing and moving the hydraulic lift cylinder by directing the leak oil between the excess flow line and the hydraulic lift cylinder line to the non-pressurized tank line by help of a spool avoid staying in pressure.

DETAILED DESCRIPTION OF THE INVENTION

The system preventing the pressured oil leakage in a cylinder line realized to fulfill the objectives of the present invention is illustrated in the accompanying FIGURE, in which:

FIG. 1 is the schematic view of a section of the control valve of the inventive system preventing the pressured oil leakage in a cylinder line and its accessory parts.

The components of the inventive system preventing the pressured oil leakage in a cylinder line given in the FIGURE are individually numbered where the numbers refer to the following:

1.) Housing
2.) Main spool
3.) Main spool spring
4.) Flow divider spool
5.) Flow divider spool spring
6.) A mechanical linkage of a lowering bolt and main spool
7.) Lowering bolt
8.) Lowering valve spring
9.) Lowering valve housing
10.) Check valve
11.) Check valve spring
12.) Flow divider pilot spool
13.) Oil inlet duct
14.) Excess flow line
15.) Flow divider and main spool link
16.) Main spool and check valve link
17.) Check valve and flow divider pilot spool link
18.) Main spool and tank line link
19.) Flow divider and main spool inlet link
20.) Flow divider pilot spool and tank link
21.) Flow divider pilot spool spring
22.) Linkage
23.) Main spool transfer line
24.) Hydraulic lift cylinder line
25.) Flow divider spool static pressure volume
26.) Hydraulic cylinder
27.) Flow divider dynamic pressure volume
28.) Oil tank
29.) Flow divider pilot spool and flow divider spring side link
30.) Position feedback mechanism
31.) Flow divider relief valve
32.) Discharge notches for leak oil on cylinder line
33.) Lowering spool tank link The objective of the invention is a system preventing pressured oil leakage in a cylinder line, and comprising:

A housing (1) including the parts on the control valve,

A main spool (2) defining raising, lowering or neutral position of hydraulic lift and the position of the same, A main spool spring (3) enabling the main spool (2) to lean on mechanical link and to switch into lowering position, A flow divider spool (4) dividing the system inlet flow into two parts such as to be cylinder line and excess flow line, Flow divider spool spring (5) functional in determining the position of the flow divider spool (4) and accordingly ratio of inlet flow to division, A mechanical linkage of a lowering bolt and main spool (6) which moves the lowering bolt when the control valve switches to lowering position, Lowering bolt (7) enabling load to be lowered by discharge of the oil trapped in the cylinder while the hydraulic lift control valve is in the lowering position, A lowering bolt spring (8) enabling the lowering bolt (7) to remain in closed position, A lowering valve housing (9) containing the lowering bolt (7) and holding the hydraulic fluid into the hydraulic cylinder by contacting to its own side while the bolt is in closed position, A check valve (10) enabling the load to stay at an adjusted height by holding the oil in the cylinder when the hydraulic lift equipment and load are lifted, Check valve spring (11) enabling the check valve (10) to stay in closed position, A flow divider pilot spool (12) preventing the system from residual pressure in the end of raising process, An oil inlet duct (13) enabling the oil to enter into the fluid flow control valve, A excess flow line (14) feeding the hydraulic systems used other than the hydraulic lift on tractor, Flow divider and main spool link (15) enabling oil link between the flow divider (4) and the main spool (2), Main spool and check valve link (16) enabling link between the main spool (2) and check valve (10), Check valve and flow divider pilot spool link (17) enabling the pressured oil going to the main spool and check valve link (16) during lifting process to arrive into the flow divider pilot spool, Main spool and tank line link (18) connecting the flow divider and main spool inlet link to the tank line according to position of the main spool (2), A flow divider and main spool inlet link (19) connecting the oil at the inlet of the main spool (2) to the end of the flow divider pilot spool (12), A flow divider pilot spool and tank link (20) opening the flow divider pilot spool link (29) to the tank according to position of the flow divider pilot spool (12), Flow divider pilot spool spring (21) enabling the flow divider pilot spool (12) to stay in closed position during the processes other than the lifting position, A main spool transfer line linkage (22) connecting the main spool transfer line (23) to the flow divider and main spool inlet link (19) according to the position of the main spool (2), A main spool transfer line (23) connecting the oil—coming from the flow divider to the main spool—to the main spool and check valve link (16) on the left side and to the main spool transfer line link (22) on the right side, A hydraulic lift cylinder line (24) enabling connection between the hydraulic lift cylinder(s) and the control valve, Flow divider spool static pressure volume (25) forcing the flow divider spool spring (5) in the direction of compression by being subject to pressure during lifting process, At least one hydraulic cylinder (26) enabling movement of the equipment attached to the hydraulic lift and the three-point hitch system attached to the same, Flow divider dynamic pressure volume (27) forcing the flow divider spool (4) to move in the direction of L by being subject to pressure during lifting process, An oil tank (28) containing hydraulic oil under atmospheric pressure, A flow divider pilot spool and flow divider spring side link (29) opening the flow divider dynamic pressure volume (27) to the tank over the flow divider pilot spool (12) by means of the flow divider pilot spool tank link, A position feedback mechanism (30) used to move the main spool (2) depending on the position of the three-point hitch system attached to the hydraulic lift, A flow divider relief valve (31) limiting the pressure occurring at the flow divider dynamic pressure volume (27), Discharge notches for leak oil on cylinder line (32) enabling discharge of the oil leaking to the cylinder line (24) to the tank (28) when the excess flow line (14) is pressurized, A lowering spool tank link (33) enabling connection of the oil trapped in the hydraulic lift cylinder(s) in the lowering position with the tank (28).

Parts showing in the FIG. 1 are built on a housing (1). The housing can either be used in a tank (28) depending on the design of the tractor or the agricultural machinery to be used or can be placed in an external environment.

The control valve has essentially three positions which are raising (R), neutral (N) and lowering (L) positions.

In the raising position, the control valve transfers the hydraulic oil directed by the hydraulic pump to the hydraulic cylinder(s) 26; thereby, the three-point hitch system attached to the hydraulic lift and the equipment attached to the same are enabled to be raised.

In the lowering position, the control valve transfers the hydraulic oil directed by the pump to the excess flow line (14) over a spool (4) while directing the oil in the hydraulic cylinder(s) to the tank over a spool (7); thereby the three-point hitch system attached to the hydraulic lift and the equipment attached to the same are enabled to be lowered.

In the neutral position, the control valve holds the oil included in the hydraulic cylinder(s) (26) by means of the check valve (11) and the lowering spool (7) and enables the cylinders to maintain their positions. Thus, the three-point hitch system attached to the hydraulic lift and the equipment attached to the same are enabled to remain stable. Meanwhile the control valve transfers the hydraulic oil directed by the pump to the excess flow line (14) over a spool (4).

For further clarification of these three positions:

Neutral position: The control valve is in the Neutral position when the main spool (2) is in a certain position indicated as N. When fluid is not sent to the control valve, that is, the tractor is not working, the flow divider spool (4) leans towards the right side as distinct from those shown in the FIG. 1 due to force of the flow divider spool spring (5). When flow is sent to the control valve, the fluid enters into the control valve by means of the oil inlet duct (13), and at that very moment, there is no or very small connection between the oil inlet duct (13) and the excess flow line (14) because the flow divider spool (4) is aligned to the right side. Thereby, the fluid is directed to the flow divider and main spool link (15) throughout the space between the fluid flow divider spool (4) valves and the housing (1); however, in the neutral position of the main spool, the connection between the main spool and check valve link (16) is closed in the left side of the flow divider and main spool link (15), and the connection between the main spool and the flow divider—main spool inlet link (19) is closed in the right side of the same, i.e. the ways of flow is closed, which is resulted in presence of pressure in the flow divider and main spool link (15). At the same time, the fluid fills into the flow divider spool static pressure volume (25) throughout the holes on the flow divider spool (4), and the pressure present in the flow divider and main spool link (15) is transferred to the flow divider spool static pressure volume (25). The pressure in the flow divider spool static pressure volume (25) causes a force on the surface of the flow divider spool (4) to compress the flow divider spool spring (5). Besides, in this position, the flow divider dynamic pressure volume (27) is open to the tank, i.e. to the flow divider pilot spool and tank link (20) through the discharge notches for leak oil on cylinder line (32) by means of the flow divider pilot spool and flow divider spring side link (29). So, the force identical with the force occurring in the flow divider spool static pressure volume (25) is not present in the flow divider dynamic pressure volume (27), and the flow divider spool (4), thereby, moves towards the left side and comes to the position shown in the FIG. 1. In this way, the fluid is directed to the excess flow line by means of the space between the oil inlet duct (13) and the excess flow line (14). The flow divider spool comes to an equilibrium position in a certain position and the inlet flow is directed to the excess flow line.

In the meantime, to prevent movement of the hydraulic cylinder(s), the hydraulic oil in the cylinder(s) is trapped into the cylinder(s) by means of the check valve (10) and the lowering bolts (7).

Raising: When the equipment is intended to be raised, the main spool (2) is moved towards the direction of R by help of the mechanism (30) which is in contact with the main spool (2). As described in the neutral position, the flow divider and main spool line, thus the main spool transfer line (23) is full of oil even in the neutral position. When the main spool (2) is moved towards the direction of R, the main spool transfer line (23) is open to the main spool and check valve link (16) in the left side and to the flow divider and main spool inlet link (19) by means of the main spool transfer line (22) in the right side. Afterwards, the pressured oil in the main spool transfer line (23) runs to the main spool inlet (2) throughout the main spool transfer line link (22) and to the right side of the flow divider pilot spool (12), whereby a force occurs on the spool to compress the flow divider pilot spool spring (21), and the spool compresses the spring on the flow divider pilot spool (21) and moves towards the left side. As a result of this movement, the connection between the flow divider pilot spool and the flow divider spring side link (29) and the flow divider pilot spool and tank link (20) is broken. Hence, the flow divider dynamic pressure volume (27) is not anymore connected to the tank link (20), i.e. to the tank and the flow divider pilot spool and the flow divider spring side link (29) is connected to the main spool and the check valve link (16) by means of the cylinder line leak oil discharge notches (32) and the check valve and the flow divider pilot spool link (17). Coming through the oil inlet duct (13), the oil is connected to the check valve (10) and then to the hydraulic lift cylinder line throughout the flow divider spool (4), the flow divider and main spool link (15), the main spool transfer line (23) and the main spool and the check valve link (16). As the flow divider spool dynamic volume (25) is connected with the main spool and the check valve link (16), the volume is now subject to pressure. So, a force which urges the spool to move in the direction of L occurs on the flow divider spool (4), and the flow divider spool (4) moves in the direction of L by means of the spring force of the flow divider spool spring (5), and the connection space between the oil inlet duct (13) and the flow divider and the main spool link (15) widens and be more in respect of the neutral position. On the other hand, the connection space between the oil inlet duct (13) and the excess flow line (14) shortens, whereby the oil starts to flow to the flow divider and the main spool link (15). The pressure on the flow divider spool spring (25) is more than the pressure on the flow divider dynamic pressure volume (27) because the oil flow loses pressure while running from the main spool transfer line (23) to the main spool and the check valve link (16). The split ratio of the inlet flow between the excess flow line and the cylinder lines can be adjusted by controlling said pressure loss. Starting from the flow divider and the main spool link (15), the flow runs into the check valve throughout the main spool transfer line (23) and the main spool and check valve link (16) respectively, then pushes the check valve (10) in the direction of L by compressing the check valve spring (11), and arrives into the hydraulic lift cylinder (26) by means of the hydraulic lift cylinder line (24) and carries out the raising process by moving the cylinder. Due to the flow divider relief valve, the pressure on the flow divider dynamic pressure volume (27) is restricted and the system is protected against the over-pressure.

Lowering: When the equipment is intended to be lowered, the main spool (2) is moved towards the direction of L by moving the mechanism (30) which is in contact with the main spool (2) towards the direction of L. In this position, the flow divider pilot spool (12) and the flow divider spool (4) is in the same position with the neutral position; that is, the fluid coming from the oil inlet duct (13) is directed to the excess flow line (14). The main spool (2) is connected mechanically with the part 6. As the main spool proceeds in the direction of L, the lowering bolt and main spool mechanical link (6) moves in the direction of L. When the lowering bolt and the main spool mechanical link (6) moves enough to contact with the lowering spool, and move the lowering bolt (7) in the direction of L by prevailing over the lowering bolt spring (8). Thereby, connection between the hydraulic lift cylinder line (24) and the lowering bolt tank link (33) is provided, and the hydraulic lift cylinder line (24) opens to the tank (28). The oil in the cylinder(s) is directed to the lowering spool the tank link (33) and then to the unpressured tank throughout the hydraulic lift cylinder line (24). The weight of the equipment tries to discharge the oil in the cylinder, whereby the oil in the cylinder is discharged and the equipment is lowered.

These three positions of the control valve work in harmony by means of the position feedback mechanism (30) in general shown schematically during the operation of the hydraulic lift. For example, when the control valve is in raising position and the equipment starts to be raised, the mechanism simultaneously release the main spool in the direction of N in order to bring the main spool into the N position, and the main spool (2) starts to move in the direction of N by the main spool spring (3). Thus, as the equipment rises the main spool moves towards the direction of N and when coming into the neutral position raising process of the equipment stops, movement of the mechanism also stops and the system remains stable in an intended level. The flow divider pilot spool (12) prevents the system from being exposed to pressure (residual pressure) during shifting from the raising position to the neutral position.

Problem of the pressured oil leakage into the cylinder line and preventive method: It is not necessary to use the hydraulic lift cylinder line and the excess flow line at the same time. When the user keeps the hydraulic lift in a stable position (the control valve is in the Neutral position) and pressurizes another hydraulic system connected to the excess flow line, the pressurized oil occurs in the excess flow line (14). Said pressurized oil runs from the notches between the flow control spool (4) and the housing into the flow divider and main spool link (15), then into the main spool transfer line (23) and main spool—check valve link (16), then into the hydraulic lift cylinder line (24) throughout the check valve (10) and then into the hydraulic lift cylinder and moves the cylinder. In the new method, the pressured oil which occurs in the main spool and check valve link (16) runs into the flow divider pilot spool (12) by means of the check valve and the flow divider pilot spool link (17). Then, by means of the cylinder line leak oil discharge notches (32) connecting the pressured oil in the check valve and the flow divider pilot spool (17) to the flow divider pilot spool and tank link (20), the pressured oil resulting from the leak oil from the excess flow line is discharged into the tank (28) before running into the hydraulic lift cylinder duct (24), whereby undesirable movement of the hydraulic lift is prevented.

As described above, in the raising position, upon movement of the flow divider pilot spool (12) to the direction of R, the connection of the flow divider pilot spool and the flow divider spring side link (29) and the check valve and the flow divider pilot spool link (17) is closed to the flow divider pilot spool tank link (20) and so to the tank (28) and the new method does not effect the raising process negatively.

The invention claimed is:

1. A system for preventing pressured oil leakage in a cylinder line (24) that is connected to a hydraulic cylinder (26), the system comprising:

a housing comprising a control valve having three positions that are a raising position, a lowering position and a neutral position, the control valve including a main spool (2) defining the raising, the lowering and the neutral positions of the control valve, the control valve controlling movement of the hydraulic cylinder (26), said housing (1) further including a flow divider spool (4) and a flow divider dynamic pressure volume (27) acting against one end of the flow divider spool (4), the flow divider spool being connected to an oil inlet duct (13), an excess flow line (14) and to the control valve through a flow divider and main spool link (15); said housing further comprising a check valve (10); said housing further comprising a main spool and check valve link (16) connecting an output port of the control valve to the check valve (10);

the housing (1) further including a flow divider pilot spool (12) preventing the system from being exposed to pressure during shifting from the raising position to the neutral position;

a check valve and flow divider pilot spool link (17) enabling the pressured oil which runs into the main spool and check valve link (16) during the raising process to arrive into the flow divider pilot spool (12);

a flow divider and main spool inlet link (19) connecting the oil in the inlet of the main spool (2) to an end of the flow divider pilot spool (12);

a flow divider pilot spool link (20) opening the flow divider pilot spool to connect the flow divider pilot spool and flow divider spring side link (29) to a flow divider pilot spool and tank link which connects to an oil tank (28);

the main spool (2) further comprising a main spool transfer link (22) connecting a main spool transfer line to the flow divider and main spool inlet link (19) according to the position of the main spool (2), wherein the housing further comprises discharge notches (32) for leak oil acting together with the flow divider pilot spool (12), the discharge notches enabling the oil leaking from the control valve to be discharged to the oil tank (28) through the main spool and check valve link (16) and the flow divider pilot spool and tank link (20) when the excess flow line (14) is pressurized.

* * * * *